US005332062A

United States Patent [19]

Revere

[11] Patent Number: 5,332,062

[45] Date of Patent: Jul. 26, 1994

[54] SIMPLIFIED SCAFFOLD LADDER

[76] Inventor: Paul Revere, P.O. Box 55, Huntington Station, N.Y. 11746

[21] Appl. No.: 662,944

[22] Filed: Mar. 12, 1991

[51] Int. Cl.[5] ..... E04G 1/00

[52] U.S. Cl. ..... 182/27; 182/118

[58] Field of Search ..... 182/27, 28, 29, 118

[56] References Cited

U.S. PATENT DOCUMENTS

| | | | |
|---|---|---|---|
| 390,687 | 10/1888 | Marsden | 182/30 |
| 581,727 | 5/1897 | Inglish | 182/30 |
| 790,177 | 5/1905 | Box | 182/30 |
| 793,748 | 7/1905 | Smith | 182/30 |
| 936,909 | 10/1909 | King | 182/30 |
| 1,271,808 | 7/1918 | Tobias | 182/29 |
| 1,343,500 | 6/1920 | Gellis | 182/30 |
| 3,566,990 | 3/1971 | Fredricks | 182/17 |
| 3,613,831 | 10/1971 | Estep | 182/27 |
| 3,724,592 | 4/1973 | Fleischer | 182/27 |
| 3,739,876 | 6/1973 | Goldberg | 182/27 |
| 4,284,171 | 8/1981 | Owen | 182/22 |
| 4,823,911 | 4/1989 | Dore | 182/119 |

*Primary Examiner*—Alvin C. Chin-Shue
*Attorney, Agent, or Firm*—Alfred M. Walker

[57] ABSTRACT

A combination scaffold ladder device having a scaffold portion which is formed by a prop positioned above a pair of ladder side members, and is connected to the sides by connecting means which include a top step and a pair of extensible spreaders. The parallel ladder side members each contain at least one indentation, and are joined together by a plurality of ladder steps with two of the steps being partial in nature. The ladder structure and the prop in the horizontal position is supported by versatile support members that are attached near the top of the versatile support member housings to the parallel ladder side members by a plurality of pivotable joint pins and locked into position by a further plurality of extensible spreaders. By placing the scaffold on its side or in a vertical position and releasing the locking means on the extensible spreaders by pivoting the versatile support members by means of pivotting joining pins into the indentations of the parallel ladder side members simultaneously joining two partial step/pullout bars of the versatile support members with their mating partial steps on the ladder structure in a parallel manner forming complete steps and transforming the invention into a flat horizontal platform. The vertical placement of the ladder structure away from the prop through the use of extensible spreaders affords the invention its stepladder configuration.

9 Claims, 4 Drawing Sheets

FIG. 1
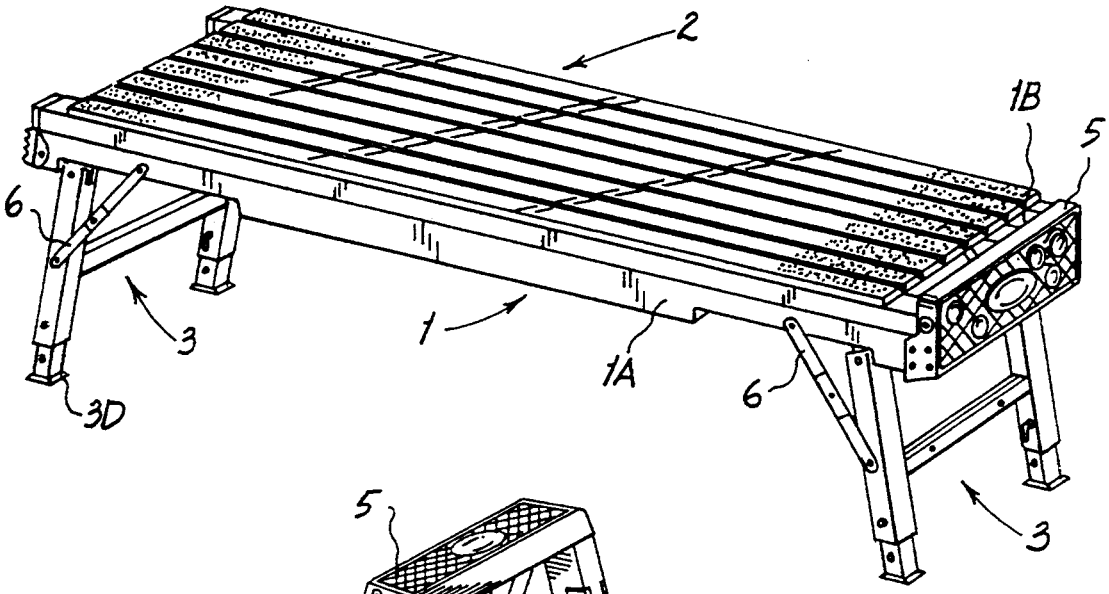
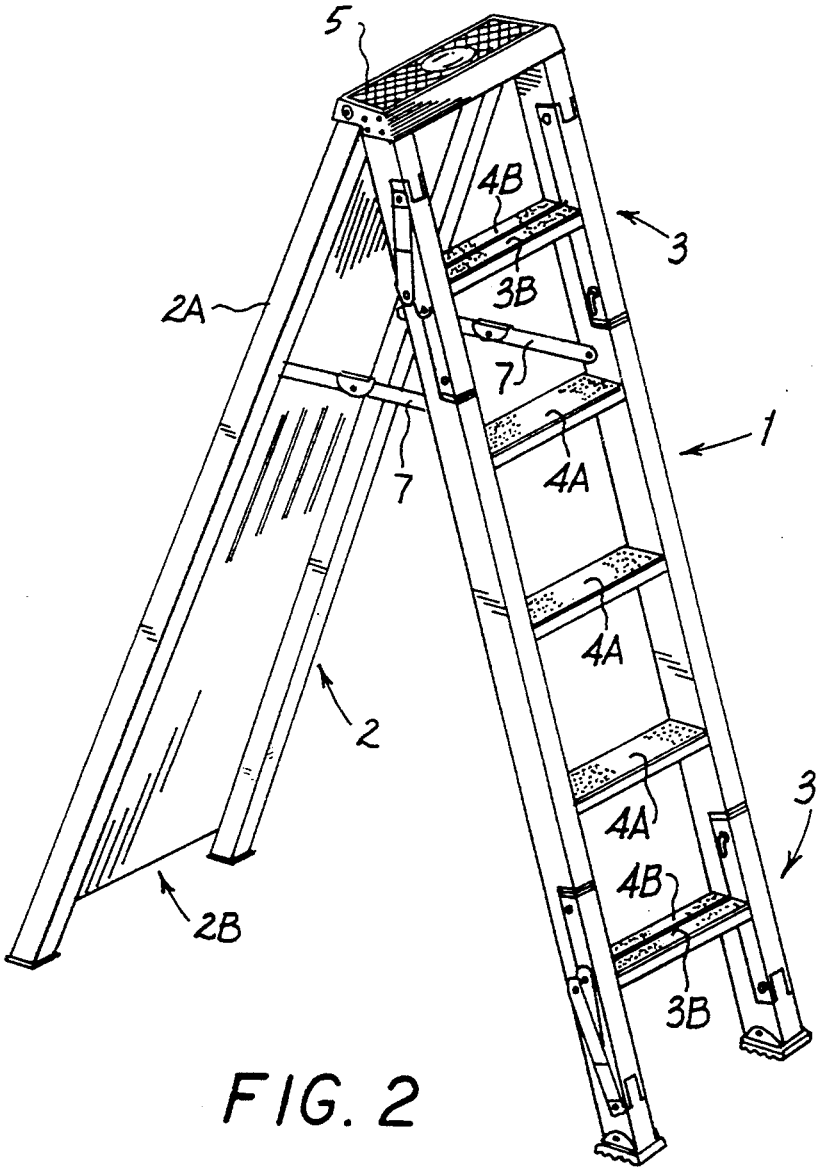
FIG. 2

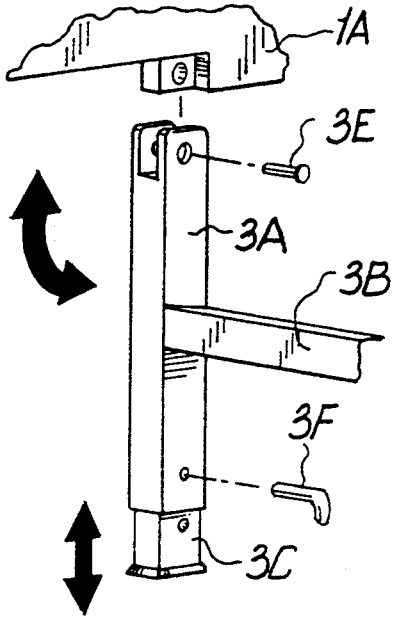
FIG. 3
FIG. 3-1
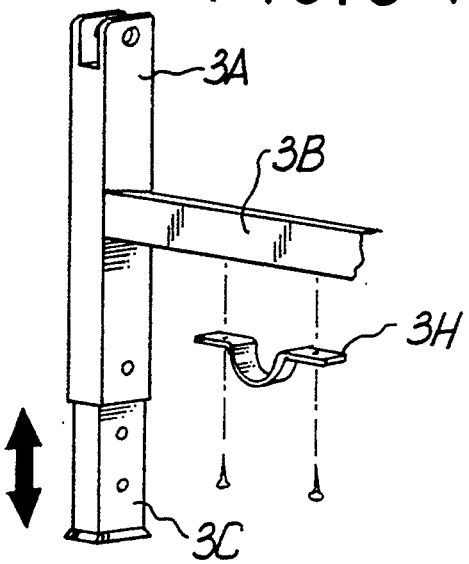
FIG. 3-2
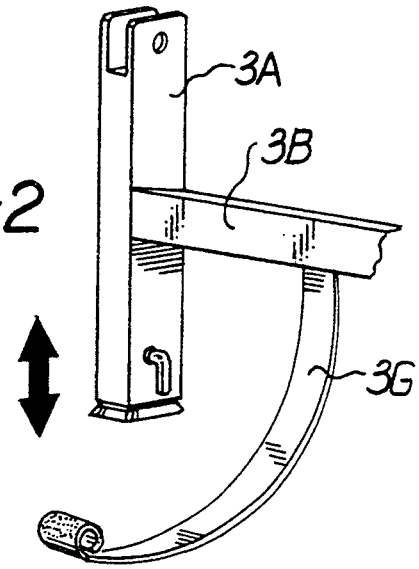
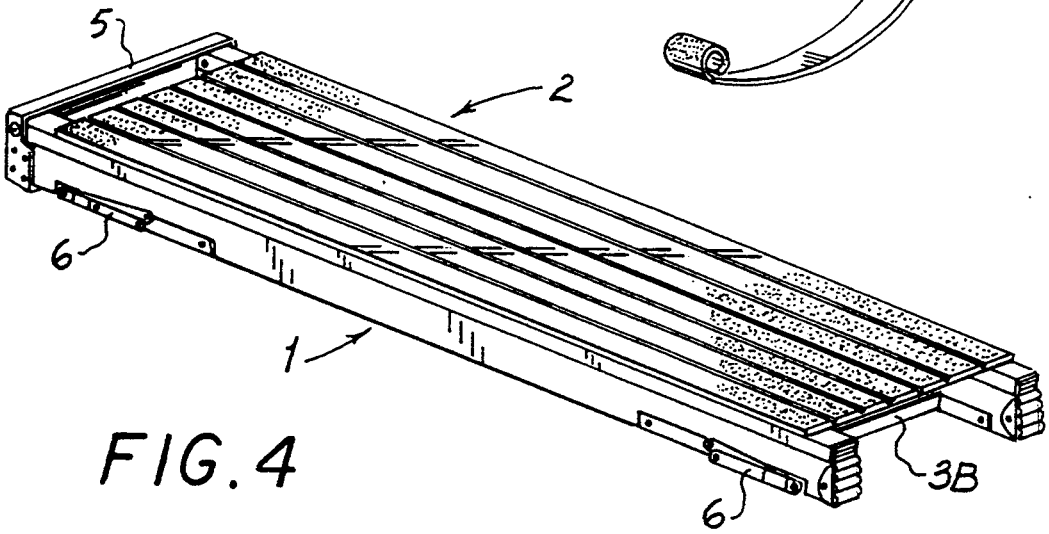
FIG. 4

FIG. 5
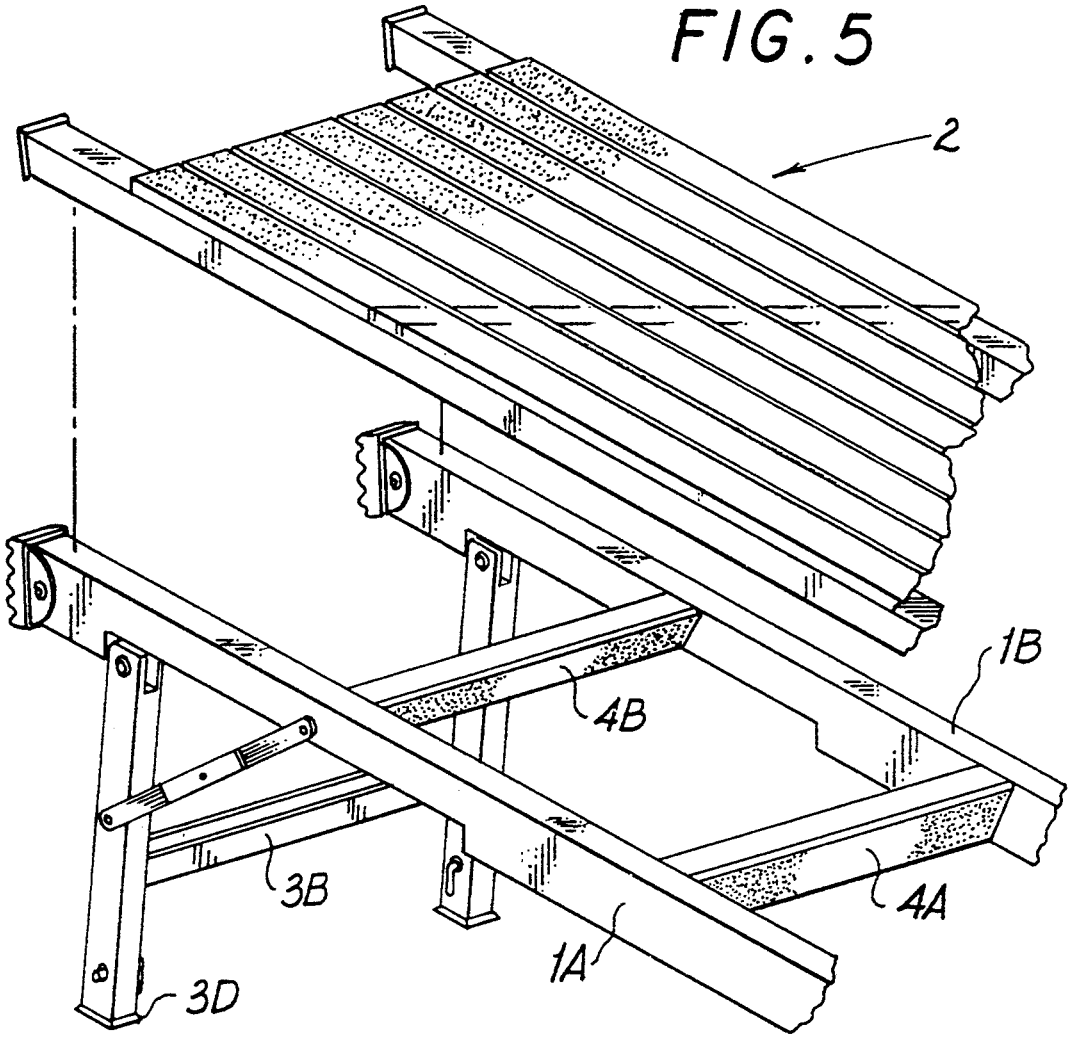
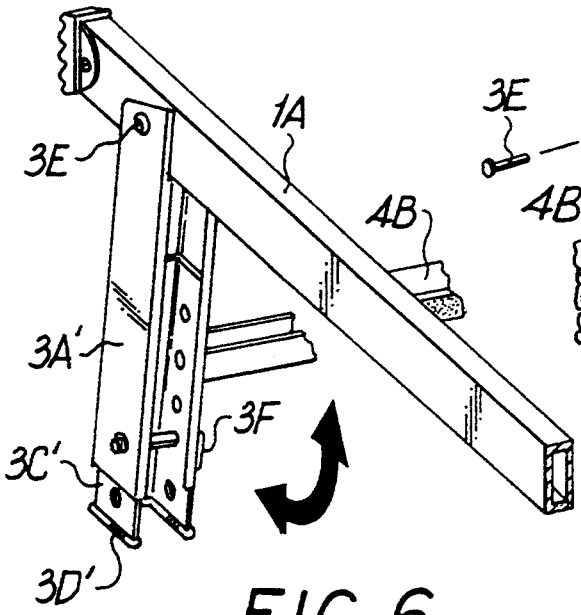
FIG. 6
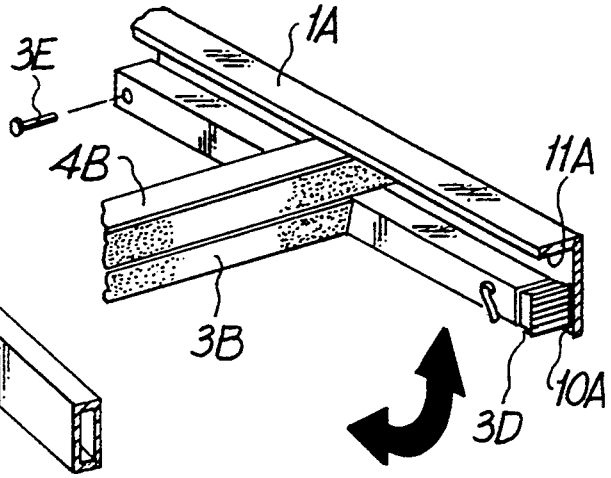
FIG. 9

FIG. 7
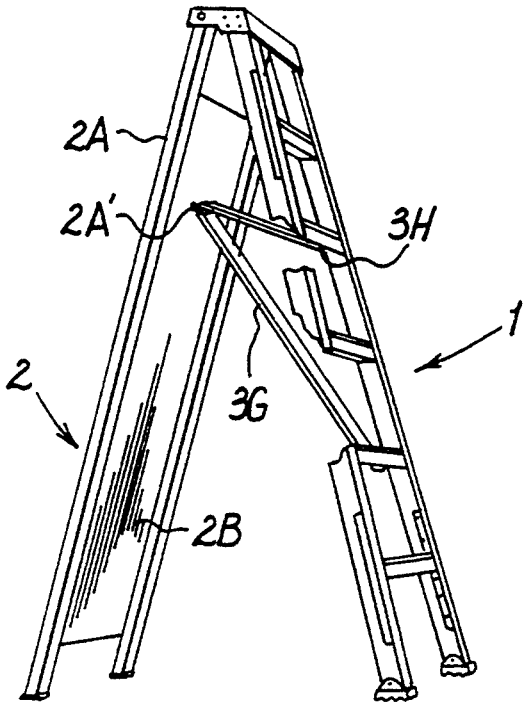
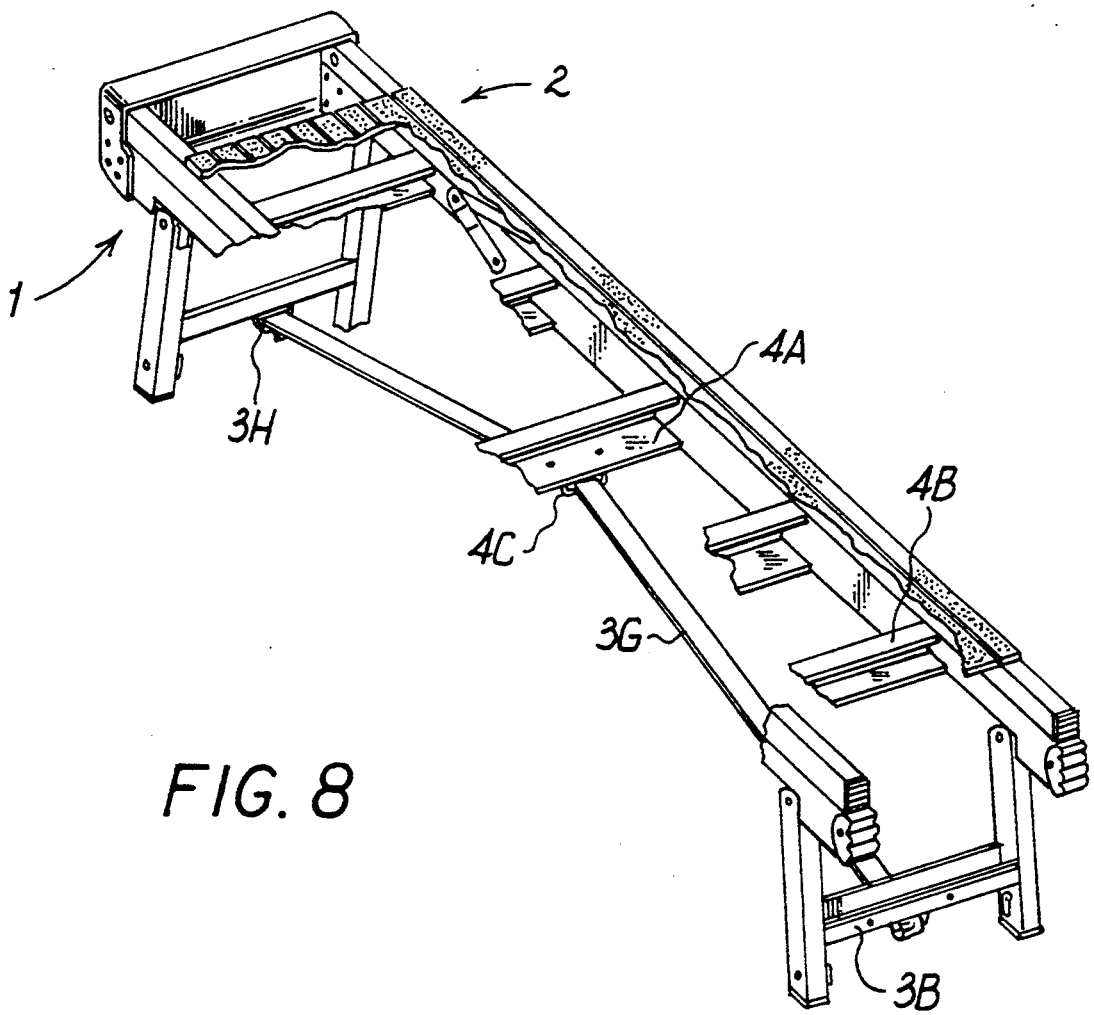
FIG. 8

SIMPLIFIED SCAFFOLD LADDER

FIELD OF INVENTION

A need for a light, durable, inexpensive and adjustable scaffold, that employs its own platform and can be easily converted into a stepladder, is obvious in the building trade, particularly in the field of building new homes (from start to finish by all tradesmen). This invention would also be greatly appreciated by homeowners and storeowners for many different reasons, like the simplicity and speed in which it can be converted and its easy storage and versatility.

The present invention relates to a combination scaffold and ladder comprising, a scaffold portion which is formed by a prop which includes two sides joined by a sheet of rigid material, which is fittably engaged on top of, and connected to, parallel side members of a ladder structure. The invention contains two indentations in the surfaces of the parallel ladder side members, which are pivotally attached to mergeable, interfittable and versatile support member assemblies that support the scaffold when in use. By placing the prop structure in a position which is parallel to that of the ladder structure with indentations, and by extending the versatile support member assemblies in an outward position, the invention permits a user to perform tasks at an elevated height, with the freedom of movement from side to side when in the scaffold mode, or can be simply converted into a standard folding ladder in approximately six seconds.

DESCRIPTION OF PRIOR ART

Combination scaffold ladders of various kinds have been made, some of which even employ scaffold platforms in their inventions, like U.S. Pat. No. 3,566,990 for a portable scaffold and U.S. Pat. No. 4,284,171 for a convertible ladder, but these and other patents have been made inadequate for different sized persons to use in houses with standard ceilings of eight or seven feet for reasons of no adjustability, being too massive for small areas, are too expensive to produce, take a lot of steps to convert, can not be converted in small areas, do not employ their own platform for a scaffold, have protruding sections making them difficult to store in a tradesman's van that is cluttered with tools and equipment that might get them caught up or entangled, or are too heavy or large for tradesmen to carry up and down stairs or from room to room all day. The within invention has blendable, interfittable and versatile scaffold support members that can unite with the ladder structure, that from a commercial stand point makes the invention, when in the step ladder mode, appear to have only two sections (a ladder structure supported by a prop) which looks to the eye to have very few parts. Also, it can quickly and simply be converted from a step ladder to a scaffold or vice versa in approximately six seconds. Plus it has the ability to have one side of its platform higher than the other to compensate for uneven ground, or all four legs can be adjusted at different levels, if necessary. This invention can also be used as a flat horizontal platform in attics, across floor and ceiling beams in framed houses, across holes in floors and many other similar circumstances.

Devices which relate to the ladder scaffolds or multipurpose ladder fixtures are known in the art. Dore (U.S. Pat. No. 4,823,911) provides a ladder scaffold which consists of parallel rails connected by rungs, along with the scaffold plank having hooks projecting onto the outer sides of said ladder. Goldberg (U.S. Pat. No. 3,739,876) provides a combination step ladder and work support which comprises a dual purpose foldable stepladder with a step-equipped front frame hingedly connected to a back prop frame to support the folded ladder for use as a work bench. Fleischer (U.S. Pat. No. 3,724,592) provides an adjustable ladder and scaffold with one or more of its legs individually extendible so as to enable it to stand or be support on an irregular surface, which can be converted into a scaffold by the addition of a leg. Fredericks (U.S. Pat. No. 3,566,990) provides a portable scaffold having a pair of castermounted ladder ends joined by a vertically adjustable platform. However, none of the prior art provides for a device wherein a scaffold is built-in directly to the ladder structure without having protruding scaffold leg assemblies or having to disengage sections, or using hooks or other awkward and cumbersome attachments.

SUMMARY OF THE INVENTION

Accordingly, it is an object of the present invention to provide a combination scaffold ladder comprising a scaffold portion which is formed by a prop positioned on top of and connected to a parallel pair of ladder side members by a top step. The ladder side members are joined by a plurality of steps, two of which are partial in nature and are further joined to the prop near their centers by extensible spreaders which permits the alternate use or storage of the invention. The ladder side members each have two indentations of identical dimensions and are supported in the horizontal position by pair of versatile support members which are connected to the side members of the ladder structure near the tops of the versatile support members housings by pivoting joint pins and near the center of versatile support members housing by extensible spreaders which secure the scaffold configuration in place.

It is another object of this invention to place a scaffold on its side or in the vertical position and to release locking mechanisms on the extensible spreaders then pivotably moving the versatile support members by joint pin means, and mingling, interfitting the versatile support members into the indentations of the parallel ladder side members. A pair of support member pullout bar/partial steps fit horizontally aside a pair of partial ladder steps on the ladder structure with indentations, to make complete steps, thereby permitting the invention to take the configuration of a flat horizontal platform. By placing the invention in a vertical position, and spreading the ladder structure outward from the prop by locking the pair of extendible spreaders in place, the invention takes the form of a conventional folding ladder.

In keeping with these objects and with others which will become apparent hereinafter, one feature of the present invention resides, briefly stated, in a combination scaffold ladder which comprises a scaffold portion which is formed by a prop which is fittably engaged on top of, and connected to a horizontal ladder structure. The invention contains two "H" shaped void areas in the ladder structure which can incorporate blendable, interfittable and versatile support members that can be used to support the scaffold when in use. By placing the scaffold in a vertical position and pivotting the prop outwards until the extensible braces are fully extended, then releasing the locking on the versatile support members braces and mingling, interfitting them into the indentations of the ladder structure of the invention by the use of pivotting joint pins, the invention permits a user to perform tasks which require either a horizontal or vertical configuration.

When the combination scaffold ladder is designed in accordance with the present invention, it attains the above mentioned objects.

The novel features which are considered as characteristic for the invention are set forth in particular in the appended claims. The invention itself, however, both as to its construction, and its method of operation, together with additional objects and advantages thereof, will be best understood from the following description of the specific embodiment when read in connection with the accompanying drawings.

BRIEF DESCRIPTION OF THE DRAWINGS

FIG. 1 is a perspective view of the scaffold part of the invention.

FIG. 2 is a perspective view of the stepladder part of the invention.

FIG. 3 is an enlarged view of the versatile support members.

FIG. 3.1 is an enlarged view of the versatile support member with alternate attaching ring shown.

FIG. 3.2 is an enlarged view of versatile support member with alternate securing device shown FIG. 4 is a perspective view of the invention, as a flat horizontal platform.

FIG. 5 shows the invention as a scaffold with its prop raised, showing complete and partial steps.

FIG. 6 is an enlarged view of an alternate versatile support member assembly made three sided.

FIG. 7 is a perspective view of the invention in a stepladder mode, secured by a securing device.

FIG. 8 is a perspective view of the invention in a scaffold configuration, secured by a securing device.

FIG. 9 is a close-up cut-away perspective view of another embodiment of a ladder side member, made L-shaped and housing support members in their closed position.

1—ladder structure comprising two sides with indentations that employ mergeable, interfittable and versatile support members and are joined by complete and partial steps.

1A—ladder side member having indentations

1B—a duplicate of 1A

2—prop comprising side members joined by a sheet of rigid material

2A—a pair of side members

2A'—alternate ring attached to prop

2B—a sheet of rigid material

3—versatile support member assembly comprising two support members each having channeled sides joined by a partial step/pullout bar

3A—Support member housing

3B—partial step/pullout bar

3C—extension leg

3D—foot

3D'—three sided foot

3E—pivotable joint pin

3F—locking pin

3G—alternate strap with attachment means

3H—.alternate ring attached to partial step/pullout bar.

3'—alternate support members assembly comprising: two support members having channelled sides and joined by a partial step/pullout bar

3A'—alternate support member housing

3C'—alternate extension leg

3D'—three sided foot

4A—full step of ladder structure

4B—partial step of ladder structure

4C—alternate ring attached to stepladder structure

5—top step

6—support member braces

7—ladder braces

10A—interior wall of an alternate ladder side member

11A—another interior wall an alternate ladder side member

DETAILED DESCRIPTION OF A PREFERRED EMBODIMENT

A combination scaffold ladder has, as seen in FIG. 1, in its free-standing scaffold configuration a prop 2 which is comprised of two sides joined by a sheet of rigid material, slightly shorter in length than each side. Surface roughness of the sheet of rigid material may be added to the demands of the user in order to assure proper footing when standing on the scaffold.

Prop 2 is situated over and connected to parallel ladder structure 1, having parallel duplicate side members 1A and 1B, by connecting means which include a top step 5 and braces 7.

As shown in FIG. 2, the ladder structure 1 has at least one mergeable, interfittable surface, and incorporates and unites, and interfits with H-shaped versatile support members 3, wherein a partial step/pullout bar 3B aligns with and merges against corresponding partial step 4B of ladder structure 1. As shown in FIG. 2, partial step/-pullout bar 3B extends as an interconnecting member between the pivotable support member housings 3A. Pivotable leg housing 3A merge and interfit with corresponding indentations within ladder side rails 1A and 1B. One embodiment as seen in FIGS. 1 and 2, shows versatile support member 3 interfittable with two mergeable, interfittable indentations on each of the ladder side members 1A nd 1B. The indentations are approximately one and one-half inches by sixteen inches long. Both sides are joined by a plurality of full steps 4A with dimensions approximately one and one-half inches by three and a half inches by fourteen inches and partial steps 4B, that are approximately one and a half inches by two inches by fourteen inches. Versatile support members 3 are attached to parallel ladder side members 1A and 1B by a plurality of pivotable joint pins 3E and a plurality of braces 6, which also secure versatile support members 3 in place.

As see in FIG. 3, housings 3A are fittably attached to parallel ladder structure 1 at or near the top part of leg housings 3A by pivotable attachments such as pivotable joint pins 3E.

As further seen in FIG. 3, each leg assembly 3 comprises two support member housings 3A which are joined by a partial step/pullout bar 3B with approximate dimensions of one and one-half inches by one and one-half inches by fourteen inches. In another embodiment, support member housings 3A may contain extension legs 3C which are supported by feet 3D and can be locked in place at a variable height as determined by the user by engaging locking pin 3F.

As seen in FIG. 4, versatile support members 3, when in a closed position, fit into the indentations on parallel ladder side members 1A and 1B of ladder structure 1, while the partial step/pullout bars 3B aligns in an angular position parallel to partial steps 4B braces 7 are in their closed position allowing prop 2 to lie on top of ladder structure 1. It is then that the invention is converted into a configuration of a flat horizontal platform.

Although FIGS. 1,2 and 4 show cutout type of indentations, an alternate embodiment of the mergeable, interfittable surface indentations in the surfaces of ladder side members 1A and 1B can include a generally L-shaped configurations able to receive the versatile support members 3 within the recess defied by the interior walls, 10A and 11A of the L-shaped configuration in FIG. 9.

it is noted that in the embodiment shown in FIG. 9, support member 3 is adjacent to interior wall 10A, but is spaced apart from interior wall 11A to allow space for rotation of support member 3 from the closed position to an open position.

Another embodiment, if preferred instead of constructing mergeable, interfittable support members of the kind described in FIG. 3, support members as in FIG. 6 could also be made with two support member housings 3A', made three sided and interconnected by a partial step/pullout bar 3B. The support member housings 3A, have retaining means such as lipped ends to house extension legs 3C' which are also made three sided. The three sided support members 3' are made to fit over, merge, interfit and unite with solid ladder side members or ladder side members with slight indentations.

If necessary, to further stabilize the scaffold/ladder on uneven terrain, another embodiment may be to add a further securing strap device. The strap device can stabilize the scaffold ladder when in a stepladder configuration, as seen in FIG. 7. Alternately, the strap device can stabilize the scaffold ladder when in a scaffold configuration, as seen in FIG. 8.

As seen in FIG. 7, further securing means also include a strap 3G approximately one and one half inches wide by sixty inches long, which is attached by attachment device to one of the partial step/bar 3B and is passed through ring 2A which is attached to prop 2 by an attachment device and is run through ring 3H which is attached to the other partial step/bar 3B by an attachment device. The strap may be secure to itself by an attachment device, such as by hook and look fasteners (Velcro ), buckles, snaps or the like.

FIG. 7 also shows strap 3G which helps ladder spreaders to secure the ladder structure to the prop 2 and also securing support members 3 into the cutouts on the ladder side members 1A and 1B.

FIG. 8 shows strap 3G which is attached to partial step/bar 3B by an attachment device. The strap 3G is then threaded through ring 4C that is attached to full step 4A near the center of the scaffold and is then run through ring 3H which is attached to the other partial step/bar 3B by an attachment device and is then secured to its self, acting as a further securing device for support members 3.

The strap is also used when the scaffold/ladder is in the flat platform mode and is firmly secured for storage.

It is obvious to one skilled in the field that this invention can be used as a portable work support configuration with little or no changes. It is also obvious that the mergeable, interfittable support members can be locked in place by locking joints or similar device. It is also obvious that the folding ladder configuration can be stabilized by a stabilizing device such as a bar attached to the bottom of the ladder side members.

It is to be understood that the form of the invention herein shown and described is to be taken as a preferred example of the same and that various changes in the shape, size and arrangement of parts may be resorted to without departing from the spirit of the invention.

I claim:

1. A convertible scaffold and ladder apparatus comprising a prop, a ladder structure including a top step connecting two side rails, said two side rails being attachable in an interfittable relationship with a plurality of support members, said support members being pivotable by pivoting means, said two side rails being interconnected by a plurality of steps, said ladder structure being joinable to said prop by said top step of said ladder structure, said ladder structure and said prop being connected near their respective centers by a plurality of braces, said plurality of support members supporting said prop and said ladder structure when said convertible scaffold and ladder apparatus is in a scaffold mode, and said plurality of support members being further connected to said two side rails by a plurality of further braces, said plurality of support members being two pairs, said plurality of support members of each pair being interconnected by one of a plurality of partial step/pullout bars, said support members being generally H-shaped and said two pairs being interfittable with at least one indentation in said ladder structure.

2. The plurality of interfittable support members of claim 1 wherein each of said interfittable support members are channeled and wherein each of said interfittable support members house at least one extension leg which said at least one extension leg is locked in place by locking means.

3. The apparatus of claim 1 wherein said ladder structure has two generally H-shaped interfittable surface indentations enabling said interfittable support members to interfit with said ladder structure with said two generally H-shaped interfittable surface indentations when said support members are in a closable position.

4. The ladder structure as in claim 1, further wherein said ladder structure having at least one interfittable surface comprises a plurality of indentations in each of said two side rails of said ladder structure.

5. A convertible scaffold and ladder apparatus comprising a prop, a ladder structure including a top step connecting two side rails, said two side rails being attachable in an interfittable relationship with a plurality of support members, said support members being pivotable by pivoting means, said two side rails being interconnected by a plurality of steps, said ladder structure being joinable to said prop by said top step of said ladder structure, said ladder structure and said prop being connected near their respective centers by a plurality of braces, said plurality of support members supporting said side rails and said prop of said convertible scaffold and said plurality of support members being further connected to said two side rails by a plurality of further braces, wherein said two side rails have, at least one indentation in each of said two side rails, said at least one indentation enabling each of said two side rails to interfit in an interfittable relationship with each of said support members when said support members are in a closed position.

6. The ladder structure of claim 5 wherein said plurality of steps includes complete and partial steps.

7. The convertible scaffold and ladder apparatus of claim 5 further includes a strap with securing means on a surface of said strap, said strap being attachable to said convertible scaffold and ladder apparatus by attachment means.

8. The convertible scaffold and ladder apparatus as in claim 7 further including a plurality of ring type devices; said plurality of ring type devices being attachable to said convertible scaffold and ladder apparatus by attachment means.

9. A combination scaffold ladder apparatus comprising a convertible scaffold configuration which includes a plurality of support members supporting and pivotly attachable in an interfittable relationship with a ladder structure by pivotable means, a plurality of first braces further connecting said support members to said ladder structure, and a plurality of further braces connecting a prop to said ladder structure, said ladder structure being further connected to said prop by an additional connecting means, wherein said combination scaffold ladder apparatus has at least one interfittable surface able to interfit with said support members when said support members are in a closed position, wherein said ladder structure having at least one interfittable surface includes two voids in said ladder structure and, wherein said ladder structure, having said two voids, has two "H" shaped indentations on its surface.

* * * * *